US005553403A

United States Patent [19]

McManus

[11] Patent Number: 5,553,403

[45] Date of Patent: Sep. 10, 1996

[54] SKISHOES WITH BRAKES AND EXTENSION AND RETRACTION LIMIT STOPS THEREFOR

[76] Inventor: John H. McManus, 1758 Indian Way, Oakland, Calif. 94611

[21] Appl. No.: 275,640

[22] Filed: Jul. 15, 1994

[51] Int. Cl.[6] ..... A43B 5/04; A63C 13/00; A63C 5/00

[52] U.S. Cl. ..... 36/124; 36/122; 280/600; 280/605

[58] Field of Search ..... 36/122, 123, 124, 36/125; 280/600, 604, 605

[56] References Cited

U.S. PATENT DOCUMENTS

| | | | |
|---|---|---|---|
| 476,572 | 6/1892 | Stone | 280/604 |
| 3,861,698 | 1/1975 | Greig | 36/122 |
| 4,085,529 | 4/1978 | Merrifield | 36/125 |
| 4,259,793 | 4/1981 | Morgan, Jr. et al. | 36/125 |
| 4,280,715 | 7/1981 | Freelander et al. | 280/600 X |
| 5,014,450 | 5/1991 | McGrath | 36/122 X |
| 5,253,437 | 10/1993 | Klebahn et al. | 36/125 X |

FOREIGN PATENT DOCUMENTS

| | | | |
|---|---|---|---|
| 0142263 | 2/1935 | Austria | 280/604 |
| 0542885 | 3/1955 | Canada | 36/125 |
| 0433183 | 4/1948 | France | 280/604 |
| 1247018 | 10/1960 | France | 280/600 |
| 2409066 | 7/1979 | France | 36/124 |
| 3003503 | 9/1980 | Germany | 280/604 |
| 0144867 | 11/1980 | Germany | 280/604 |
| 3205233 | 8/1983 | Germany | 280/605 |
| 0005721 | 4/1897 | Norway | 280/604 |
| 0298869 | 1/1910 | Sweden | 280/605 |
| 0294725 | 2/1954 | Switzerland | 280/605 |
| 0473231 | 10/1937 | United Kingdom | 280/604 |

*Primary Examiner*—Ted Kavanaugh
*Attorney, Agent, or Firm*—Schapp and Hatch

[57] ABSTRACT

A skishoe having a central, downwardly concave arch portion, an upwardly concave toe portion, an upwardly concave heel portion, and a snow gripping blade. The snow gripping blade is pivotable about an axis lying within the camber of the arch portion and extending transversely of the skishoe. A first adjustable blade stop is provided for limiting the angular deflection of the gripper blade from its fully retracted position in the camber. A second adjustable blade stop is provided for limiting the retraction of the blade into the camber, and a spring is provided for resiliently biasing the blade toward the first adjustable blade stop.

7 Claims, 5 Drawing Sheets

SKISHOES WITH BRAKES AND EXTENSION AND RETRACTION LIMIT STOPS THEREFOR

BACKGROUND OF THE INVENTION

1. Field of the Invention

My present invention relates to winter sports equipment, and more particularly to devices of the kind sometimes called skishoes, which combine certain aspects of skis with certain aspects of snowshoes and thus are adapted to permit the user thereof to traverse substantially horizontal or upwardly sloping terrain by walking, much as one may do with snowshoes, and yet to slide forwardly over downwardly sloping terrain, much as one may do with skis.

2. Description of the Prior Art

Various types of skishoes are known in the prior art.

U.S. Pat. No. 3,861,698, issued to James W. Greig on Jan. 21, 1975, discloses a combination snowshoe and ski which comprises a hollow light-weight plastic envelope which is longitudinally corrugated along its upper portion and along its bottom portion, exhibits transversely extending wedge-shaped corrugations which allow the snowshoe ski to slide forwardly but resist rearward movement, with the longitudinal and transverse corrugations being connected together to rigidify the snowshoe ski and with a foot binding on the upper portion adapted to retain the snowshoe ski on a variety of sizes of footwear.

U.S. Pat. No. 3,927,896, issued to Vincent D. Detoia on Dec. 23, 1975, discloses an attachable device which may be mounted on a ski so as to permit the ski to serve either as a snowshoe or a ski. The device incorporates an assembly of cleats that are retractably mounted over slots fitted in the ski such that the cleats may be pressed into a first position in which they project below the bottom surface of the attached ski or into a second position in which they rest flush with the bottom surface of the ski.

U.S. Pat. No. 4,334,369, issued to Paul H. Brunel on Jun. 15, 1982, discloses a ski-shoe for traveling on snow which has an elongated generally flat baseplate having an upwardly curved front end and a pair of longitudinally extending side edges. Respective upright sides extending the full length of the baseplate have lower edges joined to the side edges of the baseplate. A pair of side rails extending outwardly and downwardly from the upper edges of the sides and having lower edges lying above the baseplate form downwardly open channels with the respective sides. The foot of the user is secured to the baseplate between its front and rear ends and between the sides. At least one flap is pivotal underneath the baseplate between an axis lying ahead of the flap between and upper position lying generally against the baseplate and a down position extending transversely downwardly from the baseplate. The sides, rails, and baseplate all are made integrally of a synthetic resin and the device has an overall length of less than one meter.

It is believed that the documents listed immediately below contain information which is or might be considered to be material to the examination of this patent application.

U.S. Pat. No. 3,118,157

U.S. Pat. No. 3,269,037

U.S. Pat. No. 3,798,801

U.S. Pat. No. 3,965,585

U.S. Pat. No. 4,327,504

U.S. Pat. No. 4,652,006

SUMMARY OF THE INVENTION

Accordingly, it is an object of my present invention to provide novel skishoes which can efficiently and effectively function as snowshoes when the user thereof is traversing snow-covered, substantially horizontal terrain.

Another object of my present invention to provide novel skishoes which achieve the above object and also can function efficiently and effectively as snowshoes when the user thereof is traversing snow-covered terrain which is upwardly sloped in the user's direction of travel.

Another object of my present invention to provide novel skishoes which achieve the above objects and also can function more efficiently and effectively than conventional snowshoes when the user thereof is traversing snow-covered terrain which is upwardly sloped in the user's direction of travel.

Yet another object of my present invention is to provide novel skishoes which achieve one or more of the above objects and can also function as skis when the user thereof is traversing snow-covered terrain which is downwardly sloped in the user's direction of travel.

A further object of my present invention is to provide novel skishoes which achieve one or more of the above objects and which comprise snow gripping means, grippers, or brakes which grip the underlying snow and thus provide reaction force when the user thereof is traversing snow-covered terrain which is substantially horizontal or is upwardly sloped in the user's direction of travel.

A yet further object of my present invention is to provide novel skishoes which achieve the immediately preceding object and the grippers or brakes of which are automatically retractable by pressure exerted by the underlying snow when the user thereof is traversing snow-covered terrain which is downwardly sloped in the user's direction of travel.

An additional object of my present invention is to provide novel skishoes which attain one or more of the above objects and the effect of the grippers or brakes of which in horizontal or upwardly inclined travel is manually adjustable by the user thereof.

Another object of my present invention is to provide novel skishoes which attain one or more of the above objects and the effect of the grippers of which in downwardly inclined travel is manually adjustable by the user thereof.

Yet another object of my present invention is to provide skishoes which attain one or more of the above objects and the minimum effect of the grippers of which in downward travel is manually settable by the user thereof.

A further object of my present invention is to provide skishoes which attain one or more of the above objects and the range of effectiveness of the grippers or brakes of which is manually settable by the user thereof.

A yet further object of my present invention is to provide skishoes which attain one or more of the above objects and the angle of the grippers of which with respect to the body thereof can be set by the user thereof in accordance with the weight of the user and the depth of the snow covering the terrain over which the user thereof expects to travel.

An additional object of my present invention is to provide skishoes the grippers of which automatically change from uphill configuration to downhill configuration when the slope of the terrain being crossed by the user changes from uphill to downhill.

Another object of my present invention is to provide skishoes which attain one or more of the above objects and which are adapted to both downhill skiing and downhill walking.

Yet another object of my present invention is to provide skishoes which attain one or more of the above objects, and the grippers of which are alternatively adjustable by the user thereof for either downhill skiing or downhill walking.

Another object of my present invention is to provide skishoes which attain one or more of the above objects and the grippers of which can be locked by the user thereof at any desired angle with respect to the body thereof over a wide range of such angles.

Another object of my present invention is to provide skishoes which attain one or more of the above objects and the bodies of which are shaped in the manner of conventional bearpaw snowshoes to impart optimal weight bearing properties in the snowshoe mode.

Another object of my present invention is to provide skishoes which attain one or more of the above objects and the bodies of which are elongated, with straight or slightly incurred sides to operate optimally in the ski mode.

A further object of my present invention is to provide skishoes which achieve one or more of the above objects and at the same time include novel shoe bindings which are simple in structure, light in weight, easy to use and adapted to bind virtually any skiboot or shoe.

A yet further object of my present invention is to provide skishoes which achieve one or more of the above objects and which are provided with the boot clamps of certain well known belt-and-clamp combinations.

Other objects of the invention will in part be obvious and will in part appear hereinafter.

My present invention, accordingly, comprises the features of construction, combinations of elements, and arrangements of parts which will be exemplified in the constructions hereinafter set forth, and the scope of my present invention will be indicated in the claims appended hereto.

In accordance with another principal feature of my present invention a skishoe is comprised of a body member which is elongated in the intended direction of travel of the skishoe and has a central arch portion which defines a downwardly concave camber and snow engaging gripper blade means which is pivotably mounted for pivoting about a pivot axis which extends transversely of said camber and is substantially parallel to the wall thereof.

In accordance with yet another principal feature of my present invention biasing means is provided for resiliently biasing said gripper blade means away from its fully retracted position in said camber.

In accordance with yet another principal feature of my present invention first adjustable stop means is provided for limiting the deflection of said gripper blade means from its fully retracted position in said camber.

In accordance with a further principal feature of my present invention second adjustable stop means is provided for limiting the movement of said gripper blade means toward said fully retracted position.

In accordance with a yet further principal feature of my present invention said adjustable stop means are individually manually adjustable by means of manually operable adjustment control means which are accessible to the user of the skishoe of my present invention while standing thereupon.

In accordance with another principal feature of my present invention said body member is provided with an upwardly curved toe portion extending forwardly from said central arch portion and with an upwardly curved heel portion extending rearwardly from said central arch portion.

In accordance with yet another principal feature of my present invention a boot binding is secured to the upper face of said arch portion.

In accordance with yet another principal feature of my present invention the periphery of said body member may alternatively take the form of a continuous closed curve having no concavities.

In accordance with a further principal feature of my present invention the periphery of said body member may alternatively take the form of a "bearpaw" snowshoe of well known type.

In accordance with a yet further principal feature of my present invention said snow engaging gripper blade means is provided with a plurality of scoops each of which projects from the lower face of said gripper blade means opposite said body member and has an outer opening which lies in a plane substantially perpendicular to said gripper blade means and an inner opening which lies in the plane of said lower face of said gripper blade means.

For a fuller understanding of the nature and objects of my present invention, reference should be had to the following detailed description, taken in connection with the accompanying drawings.

DESCRIPTION OF THE PREFERRED EMBODIMENT

Figure 1:
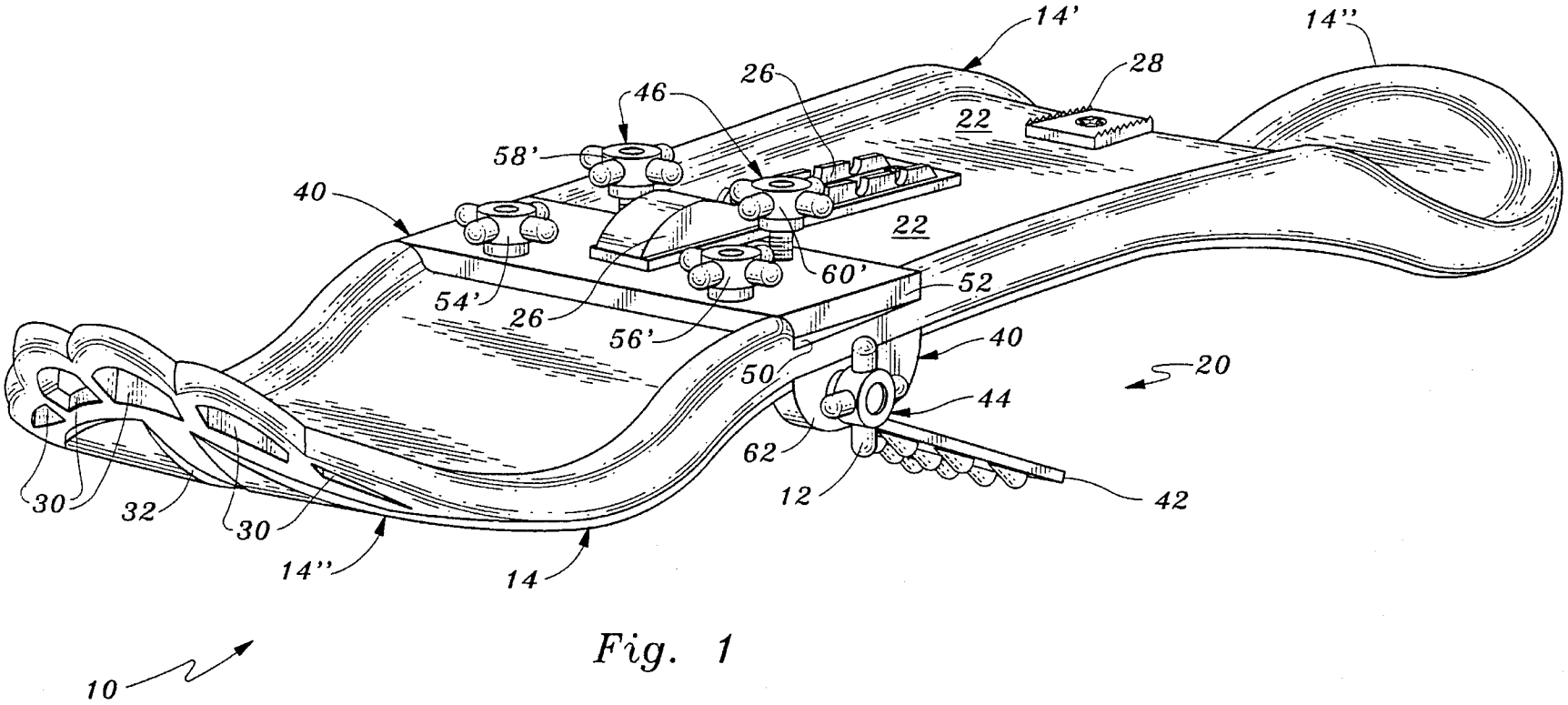
FIG. 1 is a perspective view of a left-hand skishoe of a first preferred embodiment of my present invention.

Referring now to FIG. 1, there is shown a skishoe 10 of the first preferred embodiment of my present invention, sometimes called a "ski-paw", which is adapted for wearing on the user's left foot.

It is to be understood that skishoe 10 is but one of a pair of the skishoes of the first preferred embodiment, the other skishoe 10' of that same pair being a left/right mirror image of skishoe 10.

Figure 2:
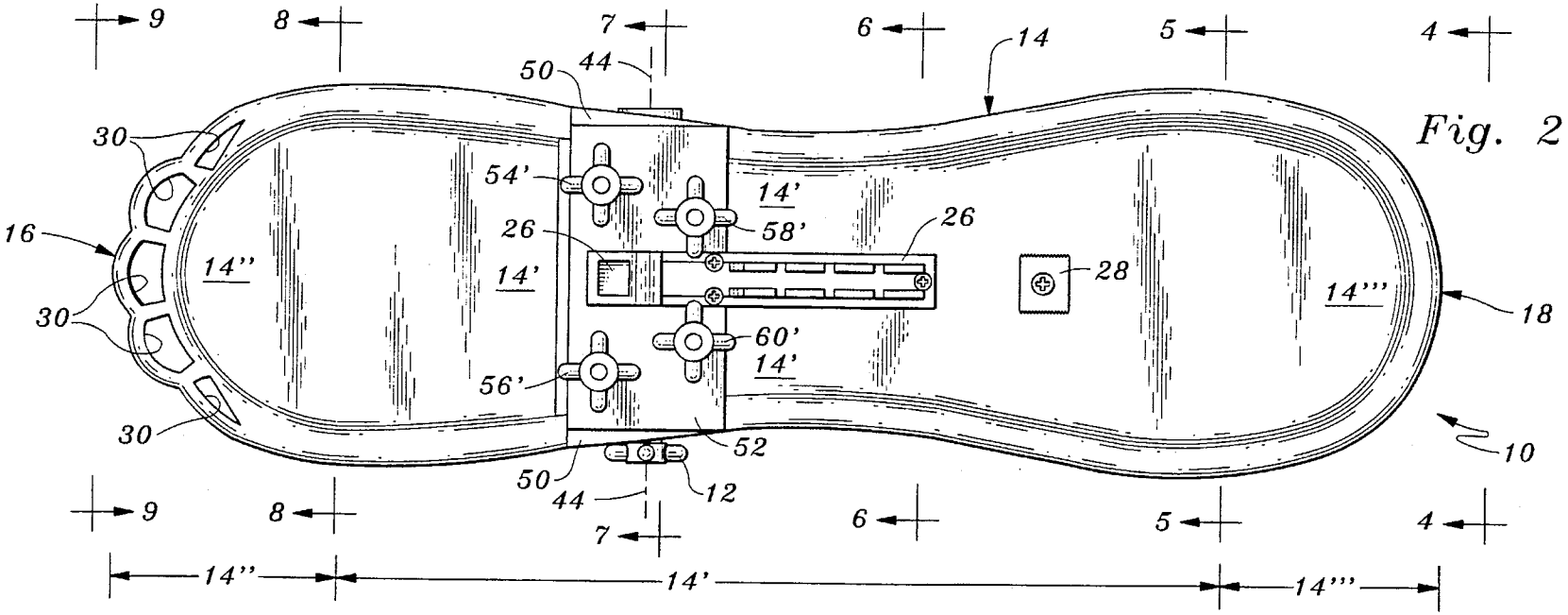
FIG. 2 is a plan view of the skishoe of the first preferred embodiment of my present invention shown in FIG. 1.
Figure 3:
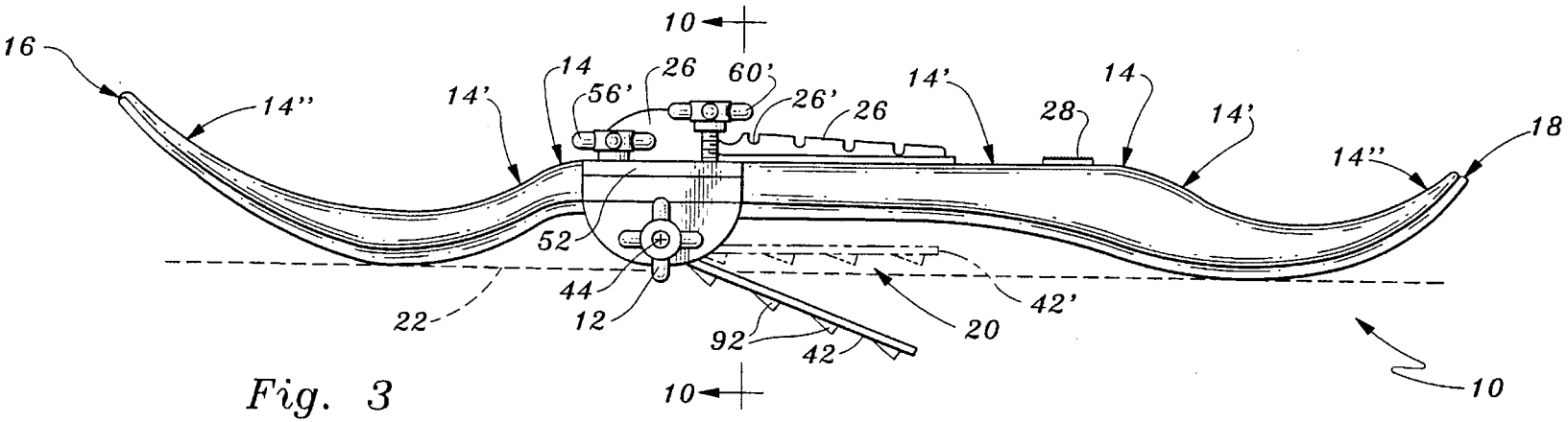
FIG. 3 is an elevational view of the skishoe body of the first preferred embodiment of my present invention shown in FIGS. 1 and 2.
Figure 4:
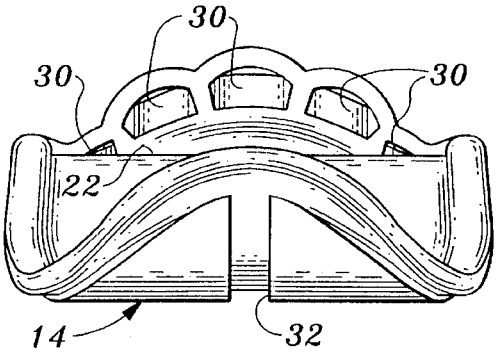
FIG. 4 is a rear view of the skishoe body of the first preferred embodiment of my invention shown in FIGS. 1 and 2, taken on plane 4—4 of FIG. 2.
Figure 5:
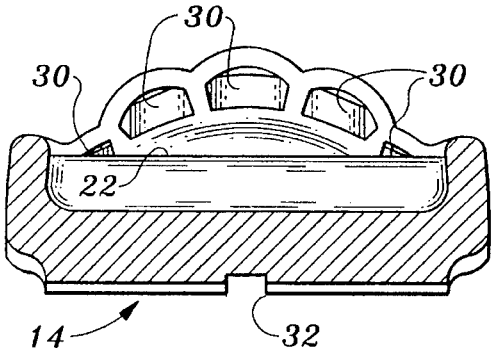
FIG. 5 is a cross-sectional view of the skishoe body of the first preferred embodiment of my present invention shown in FIGS. 1 and 2, taken on plane 5—5 of FIG. 2.
Figure 6:
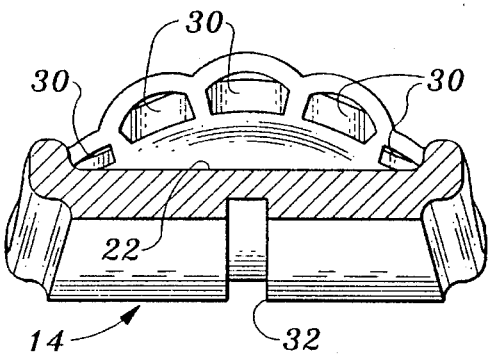
FIG. 6 is a cross-sectional view of the skishoe body of the first preferred embodiment of my present invention shown in FIGS. 1 and 2, taken on plane 6—6 of FIG. 2.

Referring now to FIG. 1, and comparing the same with FIGS. 2 and 3, it will be seen that skishoe body 14, while unitary in construction, may be thought of as being comprised of three portions, viz., the arch portion 14', the toe portion 14", and the heel portion 14'".

As best seen in FIG. 2, arch portion 14' of body 14 extends from cutting plane 8 to cutting plane 5; toe portion 14" extends from forwardmost point 16 of body 14 to cutting plane 8; and heel portion 14'" extends from the rearwardmost point 18 of body 14 to cutting plane 5.

Skishoe body 14 is preferably molded as a single piece from a plastic material of well known type which is of sufficient strength and rigidity so as to remain in substantially the same configuration as that shown in FIGS. 1 through 3 throughout the use of skishoes 10, 10'. In some embodiments body 14 may be somewhat resilient. It is to be understood, however, that my invention is not limited to the employment of any particular material or construction in fabricating body 14. Thus, body 14 may, in certain embodiments of my invention be fabricated from metallic material, e.g., aluminium, or epoxy-bonded fibreglass.

In FIG. 3, it will be seen that arch portion 14' defines, with tangent plane 22, a camber 20.

Referring again to FIG. 1, it will be seen that arch portion 14' has a substantially planar upper face portion 22, to which is affixed a boot anchor 26 and a heel plate 28.

Boot anchor 26 may, for example, and not by way of imitation, be a boot anchor of the type made and sold under the trade designation Rottefella. Heel plate 28 may, by way of example, and not by way of limitation, be a heel plate of the type supplied with the abovesaid Rottefella boot anchor.

As further seen in FIGS. 1, 2 and 4 through 9, a plurality of apertures 30, preferably five in number, pass through toe portion 14" closely adjacent the leading edge thereof.

As seen in FIGS. 1 and 4 through 9, a longitudinal groove 32 is provided in the bottom face of body 14, which extends substantially from end to end of body 14.

Referring now to FIG. 1, it will be seen that an assembly 40 of parts is mounted on body 14 at the forward end of the planar upper surface portion or deck 22 thereof, i.e., the end of deck 22 adjacent toe portion 14".

For reasons which will become apparent hereinafter, assembly 40 will sometimes be called herein the "gripper assembly" or "gripper".

Figure 10:
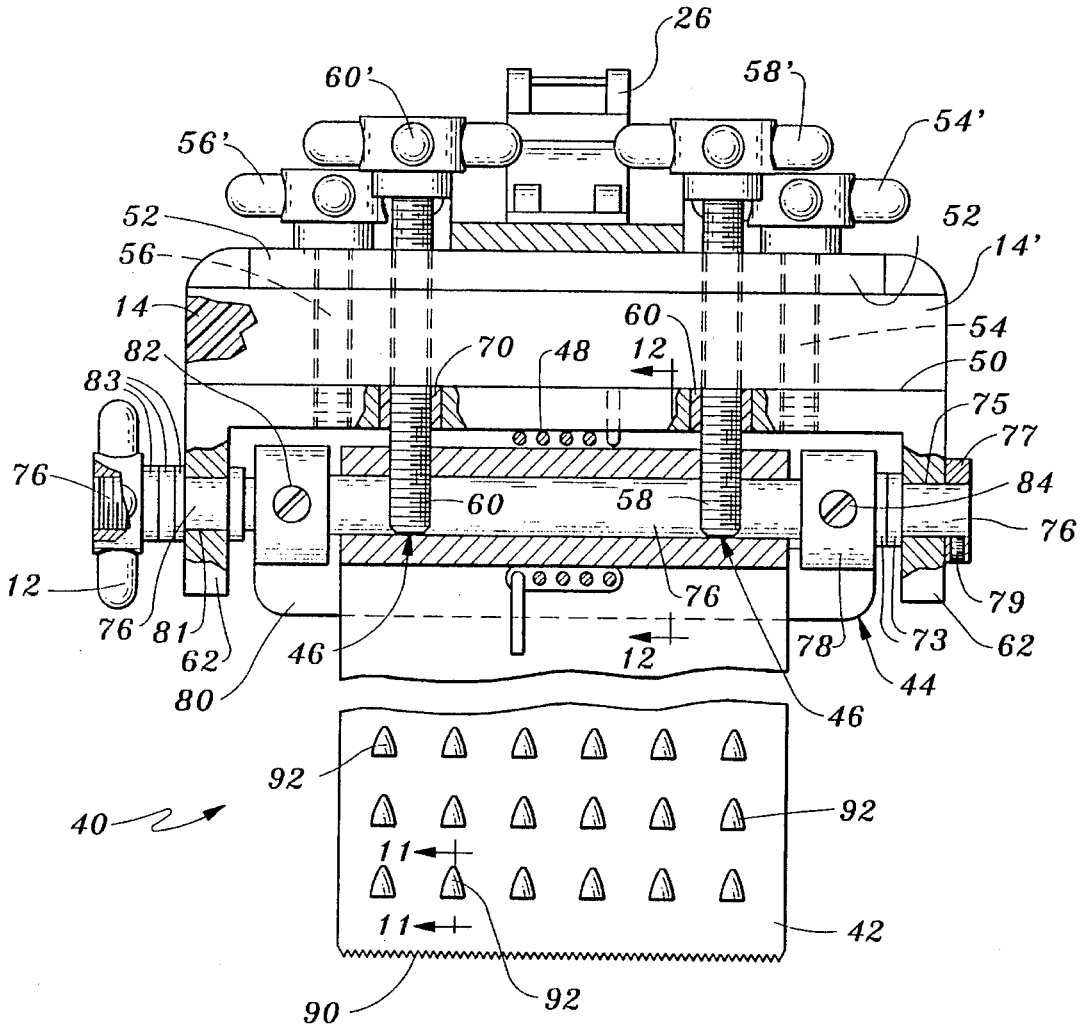
FIG. 10 is a cross-sectional view of the skishoe of the first preferred embodiment of my present invention shown in FIG. 3, taken on plane 10—10 of FIG. 3.

The principal parts of gripper brakes 40 and their relationship to body 14 are shown in detail in FIG. 10.

Gripper brakes 40 is comprised of a projecting member 42, shown in FIGS. 1, 3 and 10, which is sometimes called the "gripper blade" or "brake blades" herein.

As explained hereinafter in connection with FIGS. 1, 3 and 10, blade 42 is mounted for rotation about an axis 44 (FIGS. 2 and 3), and thus can be angularly deflected about axis 44 from its fully retracted position 42', shown in dashed lines in FIG. 3, to any one of a large number of deflected positions, one of which is shown in solid lines in FIG. 3.

As also explained hereinafter, first adjustable brake blade stop means 44 is provided for limiting the deflection of blade 42 from its fully retracted position 42' (FIG. 3), and second adjustable retraction limit stop means 46 is provided for limiting the return movement of blade 42 to its fully retracted position 42', i.e., for preventing blade 42 from more closely approaching its fully retracted position (42', FIG. 3) than a selected minimum angle of deflection.

As also seen in FIG. 10, gripper assembly 40 includes a coil spring or deflection spring 48 by means of which blade 42 is resiliently biased against first adjustable blade stop means 44, and thus is maintained in the currently selected one of said deflected positions except when urged from that position, e.g., by the snow over which skishoe 10 is passing.

Referring now to FIGS. 4 through 9, the contours of body are shown in detail. It is to be particularly noted that for clarity of illustration gripper assembly 40, boot binder 26 and heel plate 28 are not shown in FIGS. 4 through 9.

Deck 22 is shown in FIGS. 4 through 7.

Figure 7:
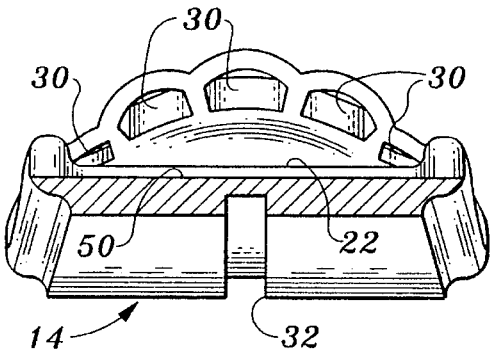
FIG. 7 is a cross-sectional view of the skishoe body of the first preferred embodiment of my present invention shown in FIGS. 1 and 2, taken on plane 7—7 of FIG. 2.
Figure 8:
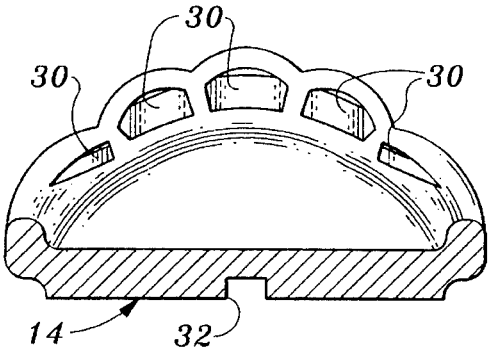
FIG. 8 is a cross-sectional view of the skishoe body of the first preferred embodiment of my present invention shown in FIGS. 1 and 2, taken on plane 8—8 of FIG. 2.
Figure 9:
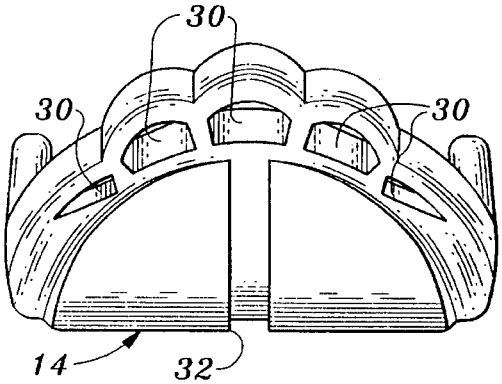
FIG. 9 is a front view of the skishoe body of the first preferred embodiment of my present invention shown in FIGS. 1 and 2, taken on plane 9—9 of FIG. 2.

The portion 50 of body 14 which is recessed below deck 22 and receives the upper bracket 52 of gripper assembly 40 is shown in FIGS. 1, 2, and 7.

Referring now to FIG. 1, it will be seen that the star wheel heads 54', 56', of bolts 54, 56 (FIG. 10) overlie upper bracket 52 of gripper assembly 40 when skishoe 10 is fully assembled.

As also seen in FIG. 1, the star wheel heads 58', 60' of bolts 58, 60 (FIG. 10) overlie upper bracket 52 of gripper assembly 40 when skishoe 10 is fully assembled.

Referring now to FIG. 10, it will be seen that gripper assembly 40 is comprised of upper bracket 52 and lower bracket 62, between which is clamped a portion of body 14, lower bracket 62 bearing against the bottom of arch portion 14' of body 14 and upper bracket 52 bearing against the recessed portion 50 of the upper surface of arch portion 14' of body 14.

As further seen in FIG. 10, bolt 54 passes through a clearance hole in upper bracket 52 and thence through a clearance hole in arch portion 14'. The lower end of bolt 54 is then threadedly received in a tapped hole in lower bracket 62.

When the lower end of bolt 54 is fully engaged with said tapped hole in bracket 62, as shown in FIG. 10, the star wheel head 54' of bolt 54 bears firmly against the upper surface of bracket 52, forcing the lower face of bracket 52 firmly against recessed portion 50 of arch portion 14' of body 14, and the upper surface of lower bracket 62 bears firmly against the lower surface of arch portion 14'.

Similarly, bolt 56 passes through clearance holes in upper bracket 52 and body portion 14' and is threadedly received in a tapped hole in lower bracket 62.

Thus, when bolts 54 and 56 pass through their associated clearance holes in upper bracket 52 and central body portion 14', and when bolts 54 and 56 are threadedly engaged in their corresponding tapped holes in lower bracket 62 and the lower ends of both bolts are fully engaged with their corresponding tapped holes in lower bracket 62, body portion 14 is firmly clamped between upper bracket 52 and lower bracket 62, the lower faces of star wheel bolt heads 54', 56' bearing against the upper face of upper bracket 52.

As further seen in FIG. 10, bolt 58 passes through clearance holes in upper bracket 52 and portion 14' of body 14, and thence through retainer bushing 68, which is affixed in an aperture in lower bracket 62. Bushing 68 is a retainer bushing of well known type which threadedly receives bolt 58 and frictionally engages it, whereby bolt 58 is prevented from rotating except in response to torque applied to star wheel head 58', and then on with considerable torque applied to head 58'. Thus, the extent of the projection of bolt 58 from the lower face of lower bracket 62 can be varied by the rotation of head 58', with considerable torque, and otherwise the extent of the projection of the lower end of bolt 58 remains unchanged.

Bolt 60 similarly coacts with retainer bushing 70, and thus the extent of the projection of the lower end of bolt 60 from the lower face of lower bracket 62 can be determined by rotation of star wheel head 60' with considerable force.

Thus, it will be obvious to those having ordinary skill in the art, informed by the present disclosure, that bolts 58 and 60, retainer bushings 68, 70, etc., serve as the second adjustable blade stop means 46 referred to hereinabove.

It will also be seen that when bolts 58 and 60 are substantially withdrawn, i.e., their projections extending below lower bracket 62 are of a predetermined minimum length, gripper blade 42 can assume its fully retracted position 42' (FIG. 3).

It will also be seen that when bolts 58 and 60 project well below the lower face of lower bracket 62, as shown in FIG. 10, gripper blade 42 is prevented from reaching its fully retracted position 42' (FIG. 3).

It will also be seen that by suitably adjusting bolts 58 and 60 the closest angular position of blade 42 to its fully retracted position which blade 42 may assume can be fixed.

Referring again to FIG. 10 it will be seen that first adjustable blade stop means 44 is irrotatably affixed to a shaft 76 by means of two eyes 78, 80 and associated set screws 82, 84.

Each eye 78, 80 is fixed to stop means 44 by a pair of machine screws which extend through clearance holes in stop means 44 and are received in pairs of threaded bores, one pair in each eye 78, 80.

Thus, when each one of said four machine screws is fully engaged with its corresponding threaded bore in stop means 44, each eye 78, 80 is firmly affixed to stop means 44.

As also seen in FIG. 10, each eye 78, 80 is provided with a set screw 82, 84. Each set screw 82, 84 is received in a tapped bore in an eye 78, 80, the axis of each of which tapped bores intersects the axis of shaft 76; and thus when both of said set screws 82, 84 are tightened against suitable flats on shaft 76, stop 44 is irrotatably affixed to shaft 76.

Thus, it will be seen by those having ordinary skill in the art, informed by the present disclosure, that stop means 44 is affixed to shaft 76 for conjoint rotation therewith at all times.

Referring again to FIG. 10, it will be seen that the right-hand end of shaft 76 extends through a pair of washers 73 and thence through a bore 75 in the right-hand overturned end of bracket 62, and terminates in the central aperture of a retainer 77, wherein it is affixed by means of a set screw 79.

As also seen in FIG. 10, the left-hand end of shaft 76 passes through a bore 81 in the left-hand overturned portion of bracket 62, and thence into a threaded central bore in star wheel 12, the extreme left-hand end of shaft 76 being provided with external threads which coact with the threads in the central bore of star wheel 12 as hereinafter described.

Also seen in FIG. 10 is a lock washer arrangement 83 of well known type which locks shaft 76 in any desired position of rotation. More particularly, shaft 76 may be locked in any desired angular position by (1) directly or indirectly positioning shaft 76 in a desired angular position by manipulating stop 44, and (2) holding stop 44 in this position while rotating star wheel 12 to compress lock washer arrangement 83, and thus to lock shaft 76 in the desired angular position.

Figure 12:
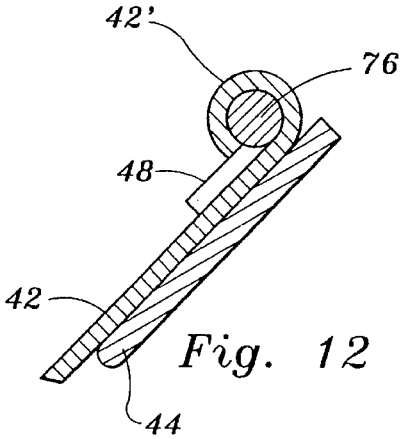
FIG. 12 is a partial cross-sectional view of the gripper blade mechanism of the first preferred embodiment of my present invention shown in FIG. 10, taken on plane 12—12 of FIG. 10.

As may be seen by comparison of FIGS. 10 and 12, blade 42 has a rolled edge 42' (FIG. 12) which close-fittingly embraces shaft 76 in such manner that blade 42 is rotatable about shaft 76.

Thus, it will be seen by those having ordinary skill in the art, informed by the present disclosure, that while stop 44 is lockable in any desired angular position about shaft 76, blade 42 is not directly lockable to shaft 76, but rather is rotatable about shaft 76 in response to the snow over which the skishoe of the present embodiment of the invention is traveling.

Blade 42 is resiliently biased by coil spring 48 into contact with stop 44, and thus assumes the angular position of stop 44, unless blade 42 is rotated out of contact with stop 44, as by snow over which skishoe 10 is traveling.

It should be noted that, in accordance with the principles of my present invention, the star wheel (12') is located on the opposite side of the skishoe body in the right-hand skishoe 10' which corresponds to left-hand skishoe 10 of the first preferred embodiment of my present invention.

Thus, it will be seen by those having ordinary skill in the art, informed by the present disclosure, that blade 42 is resiliently biased outwardly from its fully retracted position (42', FIG. 3) to an outermost position determined by the current setting of first adjustable blade stop means 44, and that blade 42 can be deflected from said outermost position to an innermost position determined by the current setting of second adjustable blade stop means 46 (FIG. 10) by the snow over which skishoe 10 is passing.

As also seen in FIG. 10, blade 42 is provided at its outer end, remote from shaft 76, with serrations 90.

As further seen in FIG. 10, blade 42 is provided with an array of scoops 92.

Figure 11:
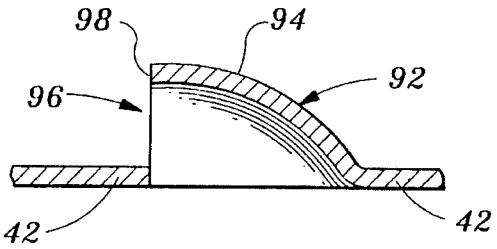
FIG. 11 is a cross-sectional view of one of the scoops of the gripper blade means of the skishoe of the first preferred embodiment of my present invention, taken on plane 11—11 of FIG. 10.

Referring now to FIG. 11, there is shown a cross-section of one scoop 92. As seen in FIG. 11, scoop 92 consists of a body portion 94, which is raised from the surface of blade 42.

As also seen in FIG. 11, body portion 94 includes an opening 96 which is surrounded by an edge of blade 42 and an arcuate lip 98.

Figure 13:
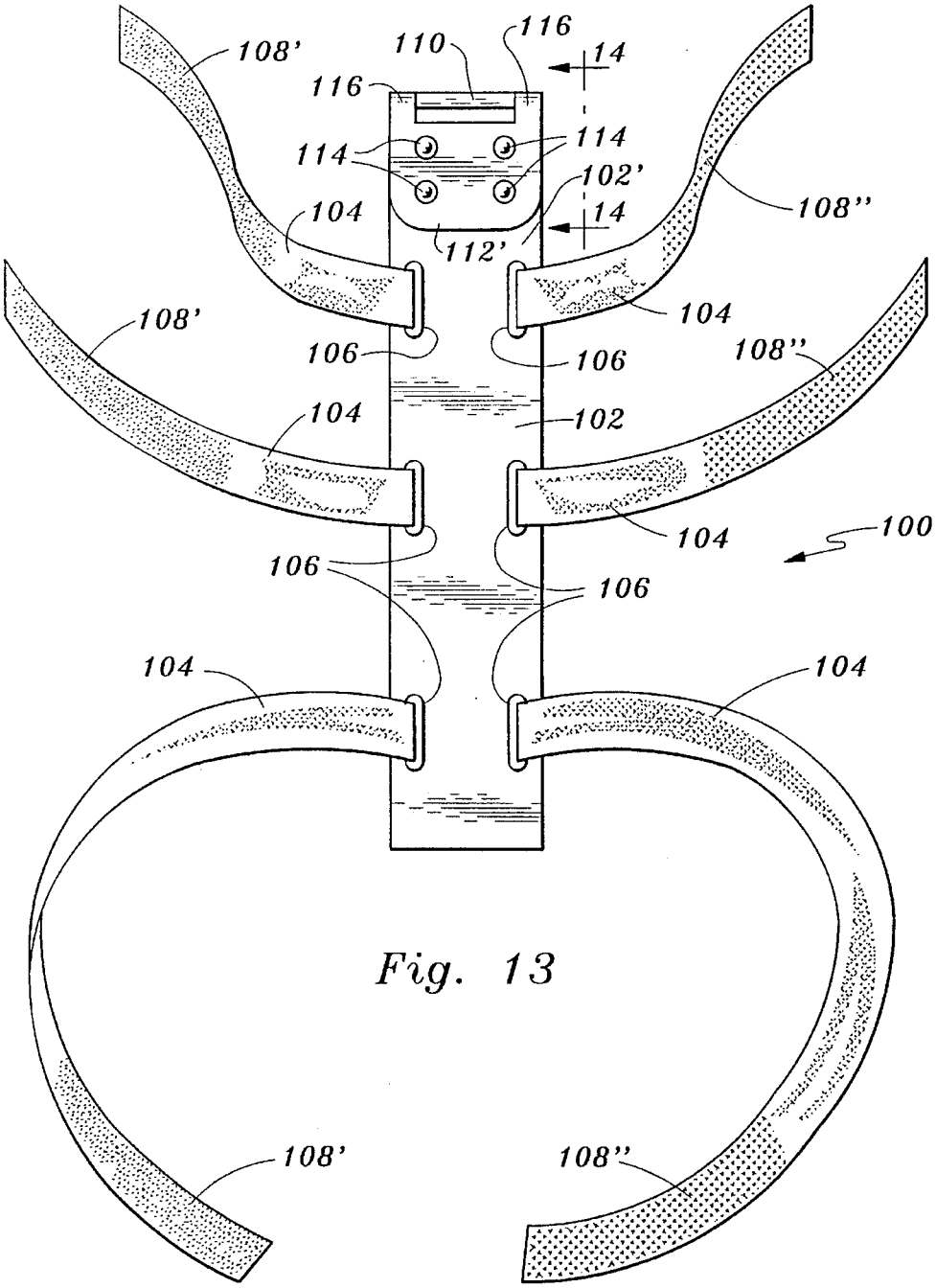
FIG. 13 is a plan view of a boot binder of my present invention as used in the second preferred embodiment of my present invention.
Figure 14:
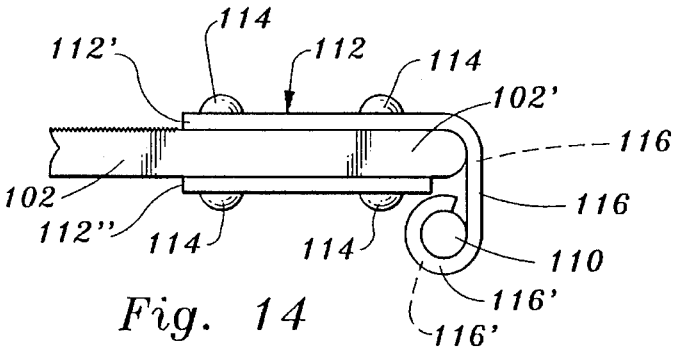
FIG. 14 is a partial elevational view of the boot binder of FIG. 13, taken on plane 14—14 of FIG. 13.

Referring now to FIGS. 13 and 14, there is shown a boot binder 100 of my present invention.

Boot binder 100 is comprised of an elongated, substantially rigid spine member 102 and a plurality of straps 104 fabricated from flexuous material such as woven nylon strapping.

Each strap 104 is anchored to spine 102 at its inner end by suitable anchoring means 106 the provision of which is within the scope of those having ordinary skill in the art.

The outer end of each strap 104 is provided with a patch of pileate fastening material of the kind sometimes sold under the trademark VELCRO. The patches indicated by the reference numeral 108' are patches of hook-type material and the patches indicated by the reference numeral 108" are patches of loop-type material.

As may be seen by comparison of FIGS. 13 and 14, a short anchoring rod 110 is affixed to the front end 102' of spine 102 by means of a mounting bracket 112.

Mounting bracket 112 is comprised of an anchor 112' and a reenforcing plate 112".

As best seen in FIG. 14, anchor 112' and reenforcing plate 112" are attached to opposite sides of the front end 102' of spine 102, anchor 112' confronting the upper face of spine 102 and reenforcing plate 112" confronting the lower face of spine 102.

Anchor 112' and reenforcing plate 112" are attached to spine 102 by means of four rivets 114 which pass through spine 102, anchor 112' and reenforcing plate 112", and are suitably headed over in the well known manner to maintain anchor 112' and plate 112" tightly joined to front end 102' of spine 102.

As may be seen by comparison of FIGS. 13 and 14, the forward end of anchor 112' is so shaped as to provide two elongated fingers 116.

As best seen in FIG. 14, both of these fingers 116 are bent downwardly over the front end of spine 102, and then formed into closed loops 116'.

As also seen by comparison of FIGS. 13 and 14, the opposite ends of anchoring rod 110 are captive in loops 116.

Rod 110 may be maintained in loops 116 by frictional engagement therewith, or may be affixed to loops 116, respectively, as by brazing or cementing.

Thus, anchoring rod 110 is seen to be rigidly positioned with respect to spine 102, in the juxtaposition shown in FIGS. 13 and 14.

Anchoring rod 110 is so configured and dimensioned that it can be disposed on the top of boot binder 26 (FIG. 3) with anchoring rod 110 locked in the anchoring means located in the bottom of anchoring slot 26' (FIG. 3).

As will be understood by those having ordinary skill in the art, informed by the present disclosure, each pair of skishoes 10, 10' of the present invention may be fitted with a pair of boot binders 100, 100' (not shown).

After locking boot binder 100 onto boot anchor 26 (FIG. 3) in the manner indicated above, and locking boot binder 110' on the corresponding boot anchor 26 of skishoe 10' in the same manner, the user of skishoes 10, 10' may place his feet on the respective boot binders 100, 100' and then secure his feet, wearing any kind of boot or shoe, to the respective boot binders 100, 100' by lacing straps 104 around his respective feet and then fastening the opposing straps together by means of the pileate fastener material patches 108', 108" affixed thereto.

In particular, the two rear straps 104 (FIG. 3) should be wrapped around the heel of each foot and then fastened together over the instep of that foot.

The middle straps 104 should pass over the instep of the associated foot and then be joined together by the patches of pileate fastening means 108', 108", and the forwardmost pair of straps 104 (FIG. 13) should then be brought together over the toe of the associated foot, and joined together by the patches of pileate fastening material 108', 108".

It will thus be seen that the objects set forth above, among those made apparent from the preceding description, are efficiently attained, and since certain changes may be made in the above constructions without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A skishoe, comprising:

a body member having an upper face and a lower, snow-contacting face opposed thereto, and having a central arch portion, an upwardly curved toe portion, and an upwardly curved heel portion;

said arch portion defining a downwardly concave camber;

snow-engaging brake blade means pivotably mounted for pivoting about a pivot axis which passes through said camber and extends transversely of said body member;

resilient biasing means for pivotally biasing said brake means about said pivot axis to extend an outer portion of said brake blade means remote from said pivot axis outwardly from said camber;

adjustable extension limit stop means for adjustably limiting the extension of said outer portion of said brake blade means from said camber; and adjustable retraction limit stop means for adjustable limiting the retraction of said outer portion of said brake blade means into said camber;

said retraction limit stop means being adjustable by a user standing on said skishoe and a skishoe paired therewith to vary the maximum retraction of said outer portion of said brake blade means into said camber.

2. A skishoe as claimed in claim 1 in which said extension limit stop means and said retraction limit stop means are simultaneously engageable with said brake blade means, whereby to fix said brake blade means at a selected degree of extension from said camber.

3. A skishoe as claimed in claim 1 in which said retraction limit stop means are adjustable by means of manually rotatable control means which are accessible to a user standing on said skishoe and a skishoe paired therewith.

4. A skishoe as claimed in claim 1 in which a boot anchor is secured to said upper face of said arch portion.

5. A skishoe as claimed in claim 4 in which a boot binder is clamped to said boot anchor, said boot binder being comprised of a rigid spine member having an anchoring rod attached to its front end which is adapted to be clamped in said boot anchor space, and being provided with a plurality of straps with which to bind a boot or shoe to said spine.

6. A skishoe as claimed in claim 1 in which a longitudinal groove extends from end to end of said lower face of said body member.

7. A skishoe as claimed in claim 1 in which a plurality of apertures pass through said toe portion adjacent the periphery thereof.

* * * * *